US007350377B2

(12) United States Patent
Kaplan

(10) Patent No.: US 7,350,377 B2
(45) Date of Patent: Apr. 1, 2008

(54) COMFORT INTERIOR FOR JEWELRY AND JEWELRY INCLUDING THAT INTERIOR

(75) Inventor: Abraham Kaplan, Tenafly, NJ (US)

(73) Assignee: Merit Diamond Corporation, New York, NY (US)

( * ) Notice: Subject to any disclaimer, the term of this patent is extended or adjusted under 35 U.S.C. 154(b) by 50 days.

(21) Appl. No.: 10/902,911

(22) Filed: Jul. 30, 2004

(65) Prior Publication Data

US 2005/0268653 A1 Dec. 8, 2005

Related U.S. Application Data

(60) Provisional application No. 60/576,869, filed on Jun. 3, 2004, provisional application No. 60/576,443, filed on Jun. 2, 2004.

(51) Int. Cl.
*A44C 9/00* (2006.01)

(52) U.S. Cl. ..... 63/15

(58) Field of Classification Search ..... 63/15, 63/15.5, 15.6, 15.65
See application file for complete search history.

(56) References Cited

U.S. PATENT DOCUMENTS

| | | | | |
|---|---|---|---|---|
| D39,049 | S | 2/1908 | Sculli | |
| 1,448,465 | A * | 3/1923 | Sherman | 63/3 |
| D83,453 | S | 2/1931 | Krasnow | |
| 2,109,609 | A * | 3/1938 | Aull | 131/258 |
| D160,275 | S | 9/1950 | Rodriguez | |
| 3,360,959 | A * | 1/1968 | Schechter et al. | 63/15.6 |
| 3,557,571 | A * | 1/1971 | De Santo | 63/15.6 |
| D279,462 | S | 7/1985 | Weikel | |
| D298,422 | S | 11/1988 | Messa | |
| D299,912 | S | 2/1989 | Goldman et al. | |
| D301,121 | S | 5/1989 | Messa | |
| D302,954 | S | 8/1989 | Goldman et al. | |
| D312,597 | S | 12/1990 | Bulgari | |
| 5,129,851 | A * | 7/1992 | Villanueva | 446/26 |
| 5,520,016 | A * | 5/1996 | Liu | 63/15 |
| 5,792,175 | A * | 8/1998 | Yoo | 606/204 |
| D438,813 | S | 3/2001 | Yellen | |
| D459,674 | S | 7/2002 | Razza | |
| 2002/0127128 | A1 | 9/2002 | Har-Shai | |

* cited by examiner

*Primary Examiner*—Jack W. Lavinder
(74) *Attorney, Agent, or Firm*—Mark S. Leonardo; Shelly L. Dorn; Brown Rudnick Berlack Israels LLP

(57) ABSTRACT

A novel structure for increased comfort and utility of jewelry items, particularly rings, is described and claimed herein. The structure, comprising a plurality of elevated surfaces within the interior of the jewelry item, allows increased blood circulation, increased air flow, and ease of cleansing, as well as increased comfort. A variety of embodiments are described.

16 Claims, 6 Drawing Sheets

COMFORT INTERIOR FOR JEWELRY AND JEWELRY INCLUDING THAT INTERIOR

BENEFIT OF PRIORITY

This application claims the benefit of now abandoned prior U.S. Provisional Patent Application No. 60/576,869, filed Jun. 3, 2004, entitled "Interior for Jewelry and Jewelry Incorporating that Interior," now abandoned prior U.S. Provisional Patent Application No. 60/576,443, filed Jun. 2, 2004, entitled "Comfort Interior for Jewelry Ring," and co-pending prior U.S. Design patent application Ser. No. 29/206,633, entitled "Jewelry Ring Interior," and filed Jun. 2, 2004, all applications having the same named applicant as inventor, namely Abraham Kaplan. Both of those applications are fully incorporated by reference herein.

FIELD OF THE INVENTION

The present invention generally relates to jewelry items. More particularly, the invention relates to a jewelry item that may be worn, for instance, on a finger, toe, wrist, or ankle, and that provides a comfort feature.

BACKGROUND OF THE INVENTION

Wearable personal ornamental items are widely popular in cultures throughout the world. Such items include, for instance but not limited to, watches, bracelets, and rings. Rings are widely worn ornaments used to decorate, for example, fingers and toes. Rings may be designed to fit a finger differently. For instance, "regular fit" bands include a flat interior. U.S. Pat. No. 6,166,053, to Seibenberg, reports "comfort fit" bands including a curved interior as reported in and shown in FIG. 2 therein. A ring interior including an annular circumferential groove is reported by U.S. Pat. No. 6,701,618, to Gefen.

Methods of fabricating rings and other jewelry items are known to those skilled in the art, and are set forth, for instance, in "The AJM Guide to Lost-Wax Casting" (MJSA/AJM Press); Mulock, J., "Cast-A-Way: The Complete Lost Wax Process for the Amateur or Professional Jeweler"; Romanoff, P., "The Complete Handbook of Centrifugal Casting"; and Romanoff, P., "The Art and Science of Centrifugal Casting Metal."

Use of gemstones, enameling, engraving, and finishing techniques in jewelry has also been described. Gemstone-setting techniques are described in Wooding, R. R., "Diamond Setting Manual: Procedures and Techniques"; Wooding, R. R., "Diamond-Setting: The Professional Approach"; Wooding, R. R., "Bead Setting Diamonds with Pave Applications"; and Wooding, R. R., "Channel Setting Diamonds with Illustrated Procedures." Jewelry finishing is described, for example, in Hoch, "Tumble Finishing for Handmade Jewelry." Engraving of jewelry is described, for example, in Meek, J. B., "The Art of Engraving." Electroplating and electroforming techniques are described, for example, in "Midas® Plating Guide," Third Edition, produced by Rio Grande. Enameling techniques are described, for example, in McGrath, J., "First Steps in Enameling"; Werge-Hartley, J., "Enamelling on Precious Metals"; Cohen, K. L., "The Art of Fine Enameling"; and Matthews, G. L., "Enamels, Enameling, Enamelists." Jewelry may also be constructed by die-striking or stamping, as discussed in McGrath, J., "The Encyclopedia of Jewelry-Making Techniques: A Comprehensive Visual Guide to Traditional and Contemporary Techniques."

A secure fit is often desirable in a ring to prevent inadvertent loss of the ring. Preferably the fit of the ring is not so secure that the wearer experiences discomfort. Other personal ornament items may be designed to effect different fit characteristics including a secure fit similar to that desirable in a ring. For example, bracelets or watch bands may be constructed to have a snug, or tight, fit.

Although a tight fit may be desirable in a jewelry item, such a fit may cause issues related to ease of use of the jewelry item. For instance, a tightly-fitting ring may be difficult to put on or to remove. Once placed, for example, on a digit or around a wrist or ankle, a tightly-fitting jewelry item may also not be comfortable to the wearer. Previous attempted solutions for increasing the comfort of a tightly-fitting jewelry item, such as those reported by patents mentioned above, may not provide a level of comfort that is entirely satisfactory.

All patents and documents referred to herein are hereby incorporated by reference as if rewritten herein in their entirety.

BRIEF SUMMARY OF THE INVENTION

It would be advantageous and is an object of the invention to have jewelry that would offer comfort benefits not offered by previous jewelry. Such a goal might be achieved, for instance, by minimizing friction between the jewelry and the wearer using a novel jewelry interior structure. Minimization of friction could provide additional benefits. These benefits are also objects of the invention. For example, a ring with a ring interior structure that minimizes friction could be put on and removed more easily. Embodiments of the invention described in the specification and accompanying drawings and defined in the claims may satisfy some or all of the objects stated above.

The invention includes a jewelry item, with an improvement of including a plurality of elevated surfaces within the interior radius of the jewelry item. In one aspect of the invention the plurality of elevated surfaces may be curved surfaces. In further aspects of the invention, the curved surfaces may be hemispheres, intersecting hemispheres, semicylinders, or intersecting semicylinders. In a further aspect of the invention, the curved surfaces are annularly situated about an interior circumference of the jewelry item. The jewelry item bearing the novel interior of the invention may include, but is not limited to, a ring, a watch, or a bracelet.

BRIEF DESCRIPTION OF THE DRAWINGS

A more complete understanding of the invention can be obtained by considering the following description with the accompanying drawings, in which FIGS. 1, 3, 4, 7-29, 31, 33-36, and 42 demonstrate perspective views of various embodiments of the invention, with FIG. 35 including a simulated digit, FIGS. 29 and 42 including an exemplary setting for a gemstone, and FIGS. 33 and 34 showing more than one ring of the invention.

FIG. 6 shows a diagram of a determination, optionally performed using a computer, of a number of hemispheres or semicylinders of the invention that may be included in one embodiment of the invention.

Figure 39:
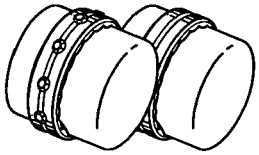
Figure 40:
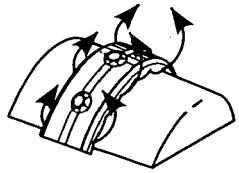
Figure 41:
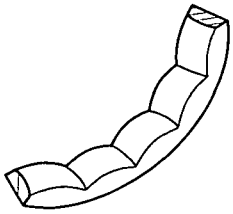
Figure 42:
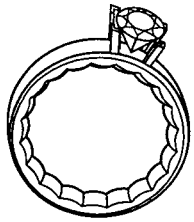

In particular, FIG. 39 includes an exemplary illustration of air flow provided by novel features of the invention.

DESCRIPTION OF THE INVENTION

A jewelry item of the invention is designed to include a novel comfort feature that minimizes contact area with a part of a person, including but not limited to a digit, wrist, or ankle. Contact area is minimized by a ring interior that provides a plurality of annularly situated hemispheres, semicylinders, or other structures. These structures may include partially intersecting hemispheres or partially intersecting semicylinders. In one aspect of the invention the annularly situated structures are curved or partially curved. In another aspect of the invention at least one of the annularly situated structures is curved or partially curved.

In yet another aspect of the invention the plurality of annularly situated structures are pyramidal or have another non-curved geometric shape. The hemispheres, semicylinders, or other shapes may define channels perpendicular to the circumference of the ring. In one aspect of the invention, a jewelry item includes a plurality of rows of annularly situated structures situated to provide a plurality of circumferential grooves.

The invention further provides a method for easing removal of a jewelry item, such as a ring of the invention, by distribution of a lubricant into the channels defined by annularly situated structures of the invention. Such a method is particularly desirable if the jewelry item is a ring, and the wearer's finger has increased in size since the ring was put on.

In one aspect of the invention the jewelry item is rigid. In another aspect of the invention the jewelry item is flexible. In yet a further aspect of the invention the jewelry item may have a varying rigidity. The annularly situated structures may be situated regularly or irregularly within the circumference of the jewelry item.

In a preferred embodiment of the invention, a plurality of regularly situated hemispheres are used. In a further preferred embodiment, the jewelry item containing a plurality of hemispheres is a ring for a finger or toe. Contact with the digit of the wearer in such an embodiment is limited to a single point per hemisphere.

Figure 9:
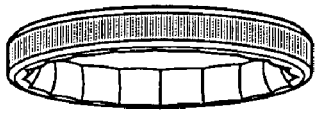
Figure 10:
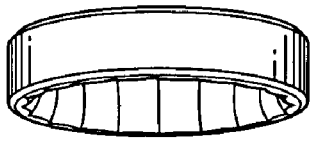
Figure 11:
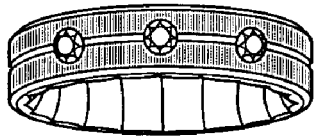
Figure 12:
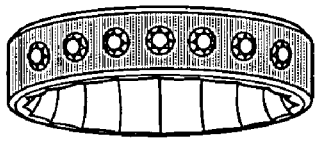
Figure 13:
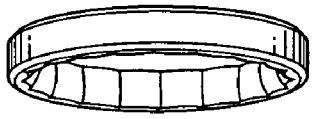
Figure 14:
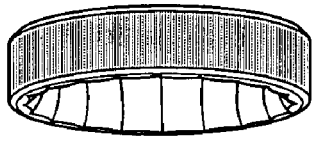
Figure 15:
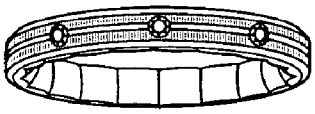
Figure 16:
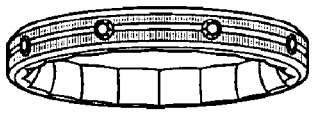
Figure 17:
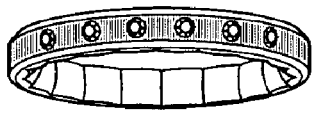
Figure 18:
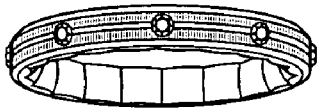
Figure 19:
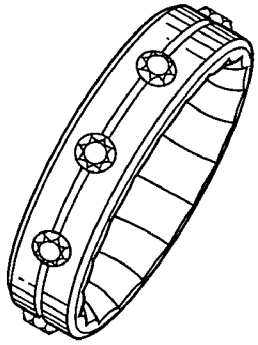
Figure 20:
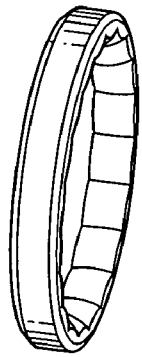
Figure 21:
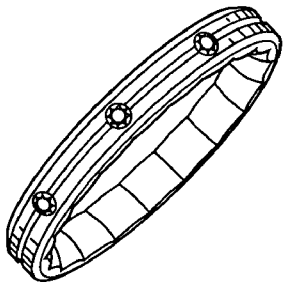
Figure 22:
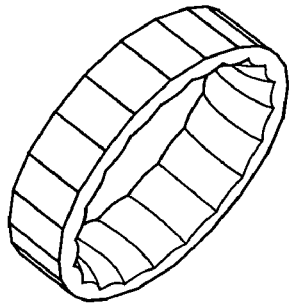
Figure 23:
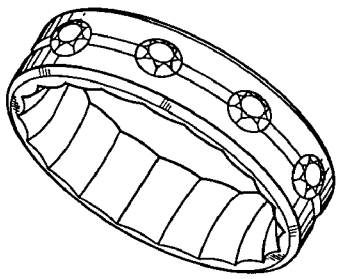
Figure 24:
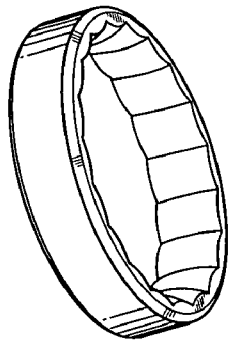
Figure 25:
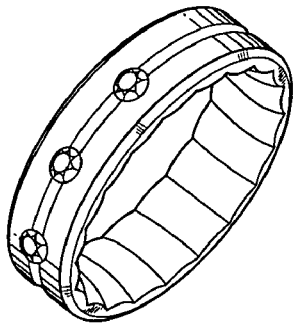
Figure 26:
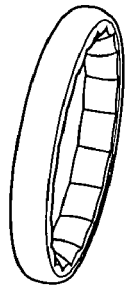
Figure 27:
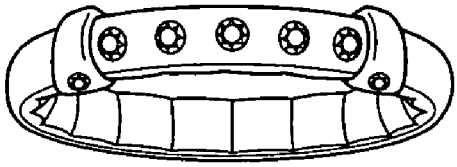
Figure 28:
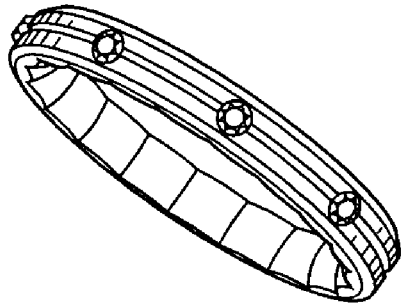
Figure 29:
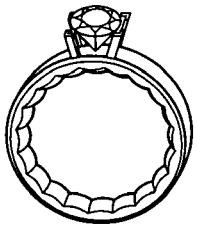
Figure 30:
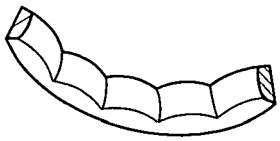
Figure 31:
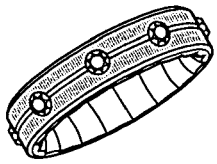
Figure 32:
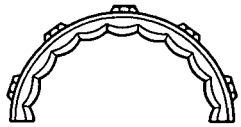
FIGS. 32 and 40 show sections of a ring embodying the invention, with FIG. 40 further including an illustration of the flow of air around and through a ring of the invention.
Figure 33:
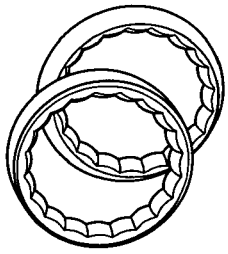
Figure 34:
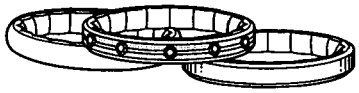
Figure 35:
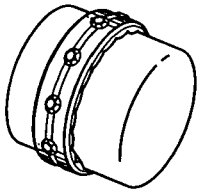
Figure 36:
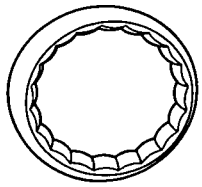
Figure 37:
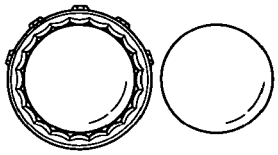
FIGS. 37-39 include a comparison of a ring of the invention (left) with a different ring.
Figure 38:
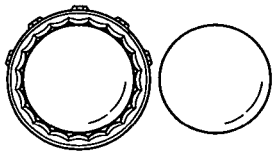

Jewelry items of the invention may include exterior ornamentation, but no ornamentation is required. For instance, an exterior of an embodiment may include one or more gemstones, such as the embodiments shown in FIGS. 12 and 15, or may patterned. An exterior may be unornamented as shown, for example, in FIGS. 9 and 10. Furthermore, it will be recognized that some embodiments of the invention may include rings or other jewelry items in which a setting structure for a gemstone, watch movement, plurality of gemstones, or other ornament or ornaments or the like is situated so that the pattern of the comfort feature in the jewelry interior is interrupted by the setting structure, movement, ornament, or the like. In one such aspect of the invention, for example, one or more of the hemispheres or semicylinders of the comfort feature of the invention is absent.

Jewelry items of the invention may be constructed from a single metal or predominately a single metal, where the metal is an elemental metal such as gold, silver, platinum, or titanium, or where the metal is an alloy. Those skilled in the art will recognize that a metal used does not need to be a pure metal. Jewelry items may also be constructed from more than one metal, for instance by an inlay pattern. In one aspect of the invention, the outer circumference of a ring is constructed of one metal, while the plurality of annularly situated structures is constructed of another metal or metals. Jewelry items of the invention may also be constructed using metal and another material, including but not limited to plastic or ceramic.

Jewelry items of the invention have a number of salutary effects. For instance, a ring of the invention has an increased air flow through and around the ring and the digit as a result of the open areas that may exist between the digit and the ring. A greater supply of atmospheric gases is available to the portion of the surface of the digit that might otherwise be entirely covered by a conventional ring, allowing the skin of the digit to "breathe."

The novel structure of the jewelry items of the invention provide the further benefit of offering increased circulation when compared to that allowed by previous jewelry. The novel features of jewelry of the invention may reduce swelling of a digit that bears the jewelry as well. As a further aesthetic and hygienic benefit, the structure of a ring of the invention allows an amount of water to pass between the ring and the digit of the wearer, allowing more efficient removal of dirt from both ring and wearer. A ring of the invention may also be put on and taken off more easily than a conventional ring.

Figure 1:
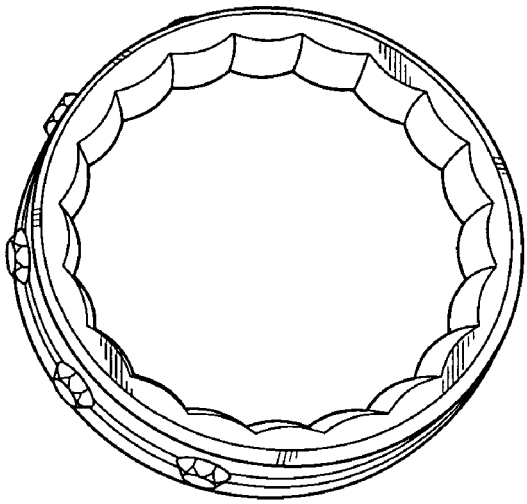
Figure 2:
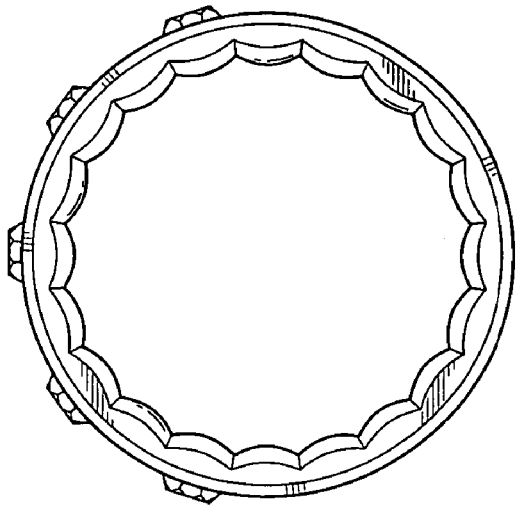
FIG. 2 and FIG. 6 demonstrate front views of a ring embodying the invention.
Figure 3:
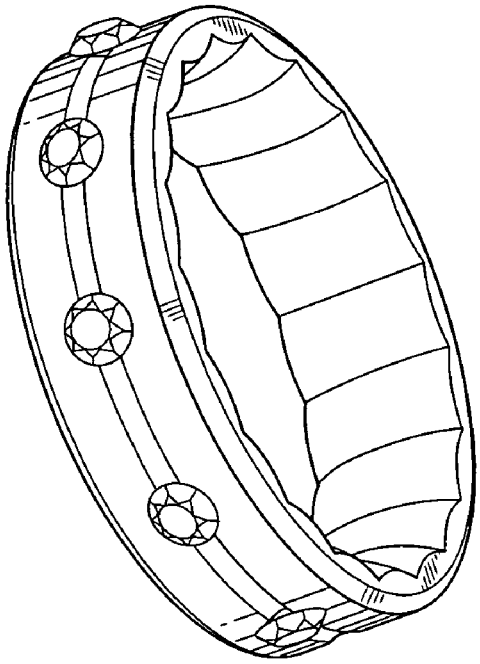
Figure 4:
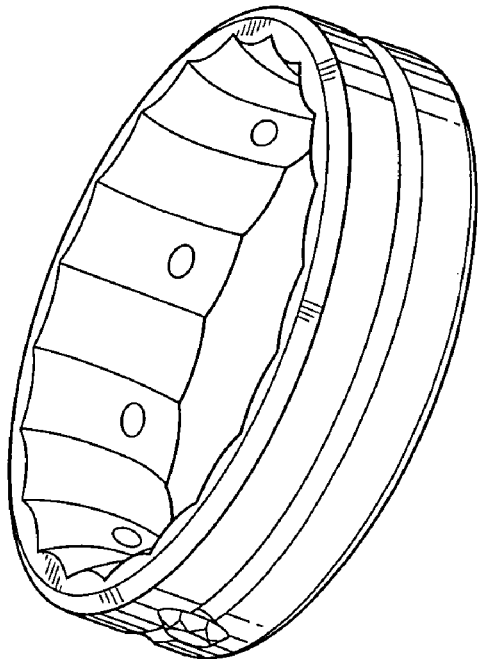
Figure 5:
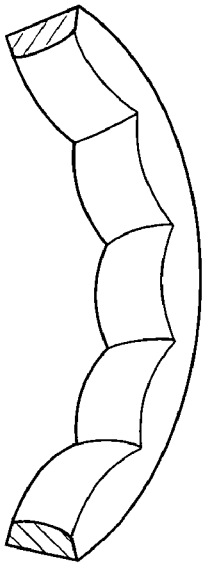
FIGS. 5, 30, and 41 show a cross-sectional perspective view of an embodiment of the invention.
Figure 6:
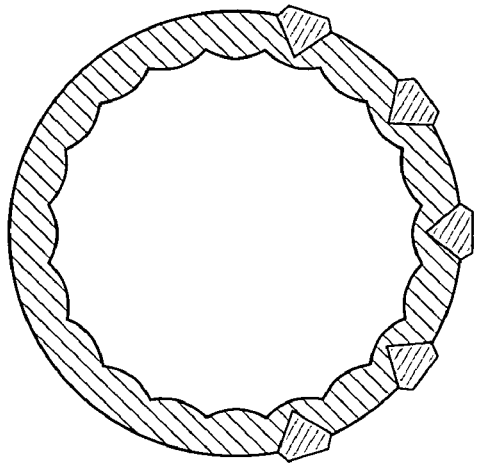
Figure 7:
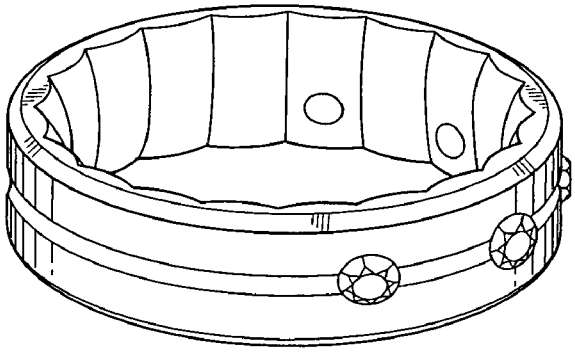
Figure 8:
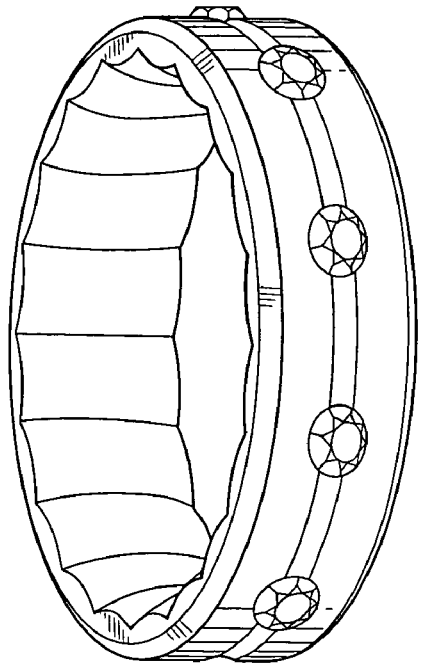

Embodiments of the invention are not limited to a particular number of hemispheres or other elements in the comfort features. A computer may be used to calculate a number of hemispheres or other comfort elements as shown, for example, in FIG. 6. Embodiments of the invention encompass a variety of jewelry items, including but not limited to rings, bracelets, or watchbands.

The number, size, and shape of the elevated surfaces in an jewelry item of the invention are not crucial, though at least four points of contact with the wearer are necessary. The number, shape, height, and spacing of the elevated surfaces may be chosen for aesthetic purposes. In a preferred embodiment of the invention the number and shape of the elevated surfaces is selected to allow the elevated surfaces to be uniform in size and equally spaced about the interior circumference of the jewelry item.

Although certain embodiments of the invention have been described herein, it will be appreciated by those skilled in the art that various modifications to the invention could be developed in light of the overall teaching of this disclosure. Accordingly, the particular embodiments disclosed herein is intended to be illustrative only, and not limiting to the scope of the invention.

I claim:

1. A circular digit ring comprising:

a plurality of elevated irregularly disposed curved surfaces being disposed in a fixed relative orientation about an inner circumferential surface of the digit ring, wherein the elevated curved surfaces form substantially the entire inner circumferential surface of the digit ring.

2. The circular digit ring of claim 1, wherein said curved surfaces are hemispheres.

3. The circular digit ring of claim 2, wherein said curved surfaces are intersecting hemispheres.

4. The circular digit ring of claim 2, wherein said curved surfaces are annularly situated about the interior circumference of said digit ring.

5. The circular digit ring of claim 1, wherein said curved surfaces are semi-cylinders.

6. The circular digit ring of claim 5, wherein said curved surfaces are intersecting semi-cylinders.

7. The circular digit ring of claim 1, wherein said curved surfaces define a plurality of regularly disposed channels perpendicular to the circumference of the digit ring.

8. The circular digit ring of claim 1, comprising the steps of:

a) providing the digit ring of claim 1;

b) providing a lubricant between said curved surfaces of said digit ring; and c) removing said digit ring.

9. A circular digit ring comprising:

four elevated curved surfaces disposed about an inner circumferential surface of the digit ring, the curved surfaces being disposed in a fixed relative orientation about the inner circumferential surface, wherein the elevated curved surfaces form substantially the entire inner circumferential surface of the digit ring.

10. The circular digit ring of claim 9, wherein said curved surfaces are hemispheres.

11. The circular digit ring of claim 10, wherein said curved surfaces are intersecting hemispheres.

12. The circular digit ring of claim 10, wherein said curved surfaces are annularly situated about the interior circumference of said digit ring.

13. The circular digit ring of claim 9, wherein said curved surfaces are semi-cylinders.

14. The circular digit ring of claim 13, wherein said curved surfaces are intersecting semi-cylinders.

15. The circular digit ring of claim 9, wherein said curved surfaces define a plurality of regularly disposed channels perpendicular to the circumference of the digit ring.

16. The circular digit ring of claim 9, comprising the steps of:

a) providing the digit ring of claim 9;

b) providing a lubricant between said curved surfaces of said digit ring; and c) removing said digit ring.

* * * * *